United States Patent [19]

Yuen et al.

[11] Patent Number: 5,041,947

[45] Date of Patent: Aug. 20, 1991

[54] DISPLAY DEVICE

[76] Inventors: Kwok-Tung Yuen, 8/F1, Flat E, Block 1, Ravana Garden, Shatin, New Territories; Kenny M. Ho, Room 1827, Chiu Man House, Oi Man Estate, Ho Man Tin, Kowloon, both of Hong Kong

[21] Appl. No.: 541,191

[22] Filed: Jun. 22, 1990

Related U.S. Application Data

[63] Continuation of Ser. No. 225,938, Jul. 29, 1988, abandoned.

[30] Foreign Application Priority Data

Jul. 30, 1987 [GB] United Kingdom ..... 878119

[51] Int. Cl.[5] ..... F21V 21/30

[52] U.S. Cl. ..... 362/35; 362/286; 362/287; 362/800; 362/806; 40/433

[58] Field of Search ..... 362/272, 275, 286, 386, 362/800, 806, 811, 419, 86, 35, 287; 40/502, 427, 429, 430, 431, 432, 433, 455, 456, 457; 446/175, 485, 242

[56] References Cited

U.S. PATENT DOCUMENTS

| | | | |
|---|---|---|---|
| Re. 21,202 | 9/1939 | Shigley | 40/433 |
| 3,707,790 | 1/1973 | Jaffe, Jr. | 362/811 X |
| 3,751,654 | 8/1973 | Grebinar . | |
| 3,760,176 | 9/1973 | Trop . | |
| 3,793,755 | 2/1974 | Gersch et al. | 362/811 X |
| 3,949,350 | 4/1976 | Smith | 362/86 |
| 4,298,868 | 11/1981 | Spurgeon | 362/811 X |
| 4,338,547 | 7/1982 | McCaslin | 362/800 X |
| 4,809,584 | 3/1989 | Forrest | 362/811 |
| 4,817,163 | 3/1989 | Stastny | 40/433 |
| 4,858,079 | 8/1989 | Ohashi | 40/431 |

FOREIGN PATENT DOCUMENTS

| | | | |
|---|---|---|---|
| 0082235 | 6/1983 | European Pat. Off. | 362/346 |
| 1472482 | 3/1969 | Fed. Rep. of Germany . | |
| 448692 | 11/1935 | United Kingdom . | |
| 709446 | 5/1954 | United Kingdom . | |
| 737821 | 10/1955 | United Kingdom . | |
| 1061381 | 8/1963 | United Kingdom . | |
| 1007257 | 1/1964 | United Kingdom . | |
| 1311663 | 3/1969 | United Kingdom . | |
| 1241369 | 12/1969 | United Kingdom . | |
| 1257379 | 12/1971 | United Kingdom . | |
| 1420982 | 1/1976 | United Kingdom . | |
| 2093617 | 2/1981 | United Kingdom . | |

OTHER PUBLICATIONS

"Led Light Show," Elektor, vol. 2, No. 6, Jun. 1976, pp. 634–637.

*Primary Examiner*—Carl D. Price
*Assistant Examiner*—D. M. Cox
*Attorney, Agent, or Firm*—Fleit, Jacobson, Cohn, Price, Holman & Stern

[57] ABSTRACT

A display device for producing a display, which device comprises a base, a rotatable member, first rotation means for rotating said rotatable member about a first axis, illumination means for producing a said display and arranged to be rotated about said first axis by said rotatable member, and second rotation means for causing movement (as herein defined) of said illumination means about a second axis different from and non-orthogonal to said first axis.

14 Claims, 12 Drawing Sheets

DISPLAY DEVICE

This is a continuation of application Ser. No. 07/225,938, filed July 29, 1988 now abandoned.

TECHNICAL FIELD

The present invention relates to a display device, and in particular to a device for generating light patterns under the control of a programmed computer or in response to an input control signal, such as a music signal.

DISCLOSURE OF THE INVENTION

According to the present invention there is provided a display device for producing a display, which device comprises a base, a rotatable member, first rotation means for rotating said rotatable member about a first axis, illumination means for producing a said display and arranged to be rotated about said first axis by said rotatable member, and second rotation means for causing movement (as hereinafter defined) of said illumination means about a second axis different from and non-orthogonal to said first axis.

The term 'movement' as used above and in the claims is intended to embrace both physical movement about a said second axis and apparent movement, such apparent movement being effected, e.g. by circular sequential switching of the elements a circular array of light-emitting diodes.

Preferably the display device comprises a base, a first rotatable member, means for rotating the first rotatable member, and at least one illumination device, and the second rotation means comprises a second rotatable member and means for rotating the second rotatable member, the first rotatable member being rotatably mounted on the base for rotation relative thereto about a first axis of rotation, the second rotatabe member being rotatably mounted on the first rotatable member for rotation relative thereto about a second axis of rotation, and the illumination device being provided on the second rotatable member.

In an alternative preferred arrangement, the display device comprises a base, a rotatable member mounted on the base, means for rotating the rotatable member relative to the base, and a light-emitting device mounted on the rotatable member, a control circuit being provided to control the speed of rotation of the rotatable member and the switching of the light-emitting device to generate a light display pattern.

Preferred features and advantages of the invention will be apparent from the following description and the accompanying claims.

BRIEF DESCRIPTION OF THE DRAWINGS

The invention will now be further described, by way of example only, by reference to the accompanying drawings, in which.

BEST MODES OF CARRYING OUT THE INVENTION

Figure 1:
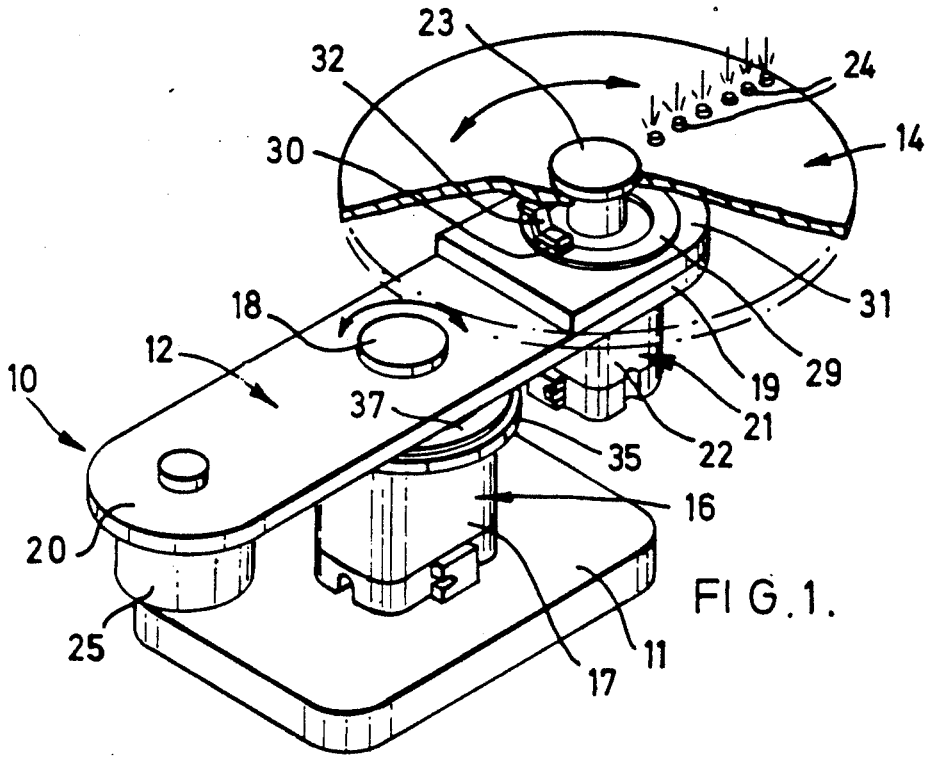
FIG. 1 is a partly cut away perspective view of a first embodiment of a display device according to the invention.
Figure 2:
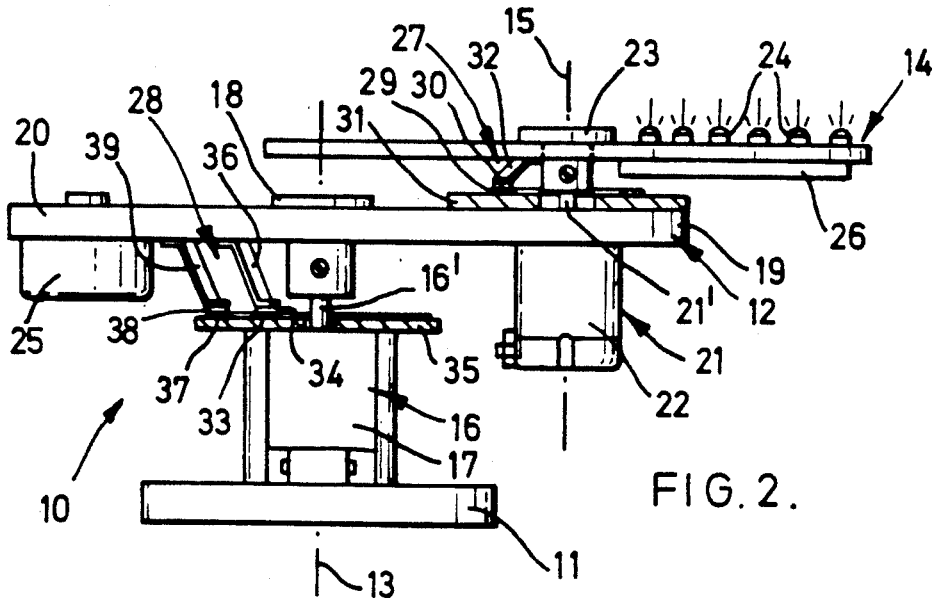
FIG. 2 is a side view of the device of FIG. 1.

Referring to FIGS. 1 and 2 of the drawings, a display device 10 comprises a base 11, a first rotatable member 12 mounted on the base 11 for rotation relative thereto about a first axis of rotation 13, and a second rotatable member 14 mounted on the first rotatable member 12 for rotation relative thereto about a second axis of rotation 15. The first rotatable member 12 is mounted on the base 11 by means of an electric motor 16 whose casing 17 is mounted on the base 11. The first rotatable member 12 is attached intermediate its ends 19 and 20 to the rotor shaft 16' of the motor 16 by means of a socket 18. The socket 18 fittably receives an end of the shaft 16' and is a force fit in an aperture in the first rotatable member 12.

The second rotatable member 14 is of disc shape and attached at its centre to the end 19 of the first rotatable member 12 by means of an electric motor 21. A casing 22 of the motor 21 is attached to the underside of the first rotatable member 12, the rotor shaft 21' of the motor 21 projecting through an aperture in the first rotatable member 12. The second rotatable member 14 is attached to the shaft 21' by a socket 23. The socket 23 fittably receives an end of the shaft 21' and is a force fit in a central aperture in the second rotatable member 14. The second rotatable member 14 carries an illumination device in the form of a plurality of light-emitting diodes 24.

A balance weight 25 is attached to the opposite end 20 of the first rotatable member 12.

A control circuit for the device 10 comprises a control module (not shown) connected to first and second control parts (the former is not shown and the latter is designated as 26 in FIG. 2). The control module may be a computer, a microprocessor-based controller or music output device. The first part of the control circuitry controls the speed of rotation of the two motors 16 and 21. Both the control module and the first control part are preferably separate from the base 11 and the rotatable members 12 and 14, and are electrically connected to annular slip rings and 37 mounted on the motor 16.

The second part 26 of the control circuitry controls the switching of the light-emitting diodes 24 in synchronism with the speed of rotation of the motors and 21, and is mounted on the underside of the second rotatable member 14. The speed of the motors and 21 and the switching or switching frequency of the light-emitting diodes 24 are synchronised, for example, to enable the generation of a constant light display pattern whilst varying the speed of rotation of the motors, the control circuit speeding up the switching of the light emitting diodes in order to maintain the light display pattern steady as the speed of rotation of the motors is increased.

The second part 26 of the control circuitry is electrically connected to the control module by means of two sets of sliding contacts 27 and 28 provided respectively between the first and second rotatable members 12 and 14, and the first rotatable member 12 and the base 11. The two rotor shafts 16' and 21' of the motors provide a return path to the electrical connection.

The sliding contacts 27 comprise a slip ring 29 and an electrically conductive brush 30 slidable on the slip ring 29. The slip ring 29 is mounted on a plate 31 on the end 19 of the first rotatable member 12. The brush 30 is mounted on and depends from the underside of the second rotatable member 14 by means of an electrically conductive leaf spring 32.

The sliding contacts 28 comprise the slip ring 33, and an electrically conductive brush 34 slidable on the slip ring 33. The slip ring 33 is mounted on a plate 35 on the upper end of the motor casing 17. The brush 34 is mounted on and depends from the underside of the first rotatable member 12 by means of an electrically conductive leaf spring 36.

Terminals of the motor 21 are connected to the first part of the control circuitry by means of the slip ring 37 and an electrically conductive brush 38 slidable on the slip ring 37. The slip ring 38 is mounted on the plate 35, and the brush 38 is mounted on and depends from the underside of the first rotatable member 12 by means of an electrically conductive leaf spring 39. The rotor shaft 16' of the motor 16 provides a return path to the electrical connection.

Terminals of the motor 16 are electrically connected to the first part of the control circuitry by electrical leads.

Figure 3:
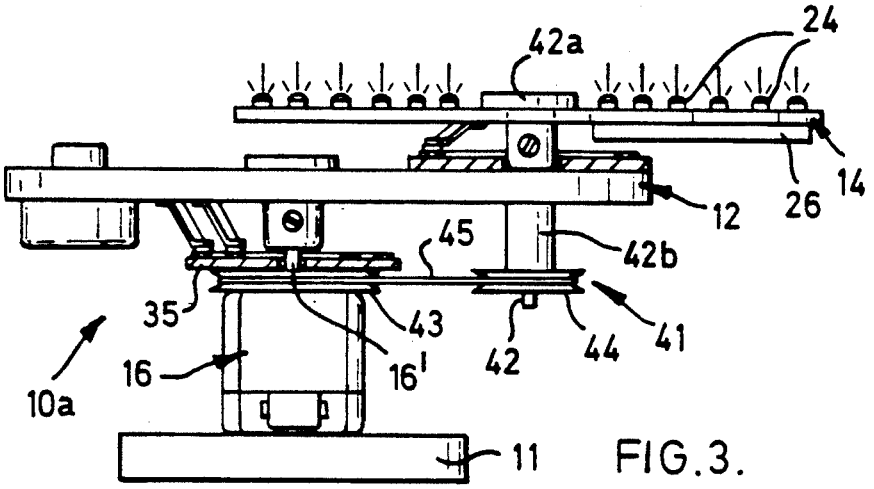
FIG. 3 is a side view of a second embodiment of a display device according to the invention.

FIG. 3 shows a second embodiment of a display device 10*a* which is similar in operation and construction to the device 10 of FIG. 1 but eliminates the need for the motor 21. The second rotatable member 14 is rotatably mounted on the first rotatable member 12 by means of a shaft 42. A socket 42*a* is a force fit in a central aperture in and supports the second rotatable member 14, the lower end of the socket 42*a* bearing on the upperside of the first rotatable member 12. Transmission means 41 is provided to transmit the rotational drive of the first rotatable member 12 to the second rotatable member 14. The transmission means 41 comprises two pulleys 43 and 44 mounted respectively on the rotor shaft 16' of the motor 16 and the shaft 42, and a belt 45 connecting the two pulleys 43 and 44. A tubular spacer 42*b* is mounted on the shaft 42 between the first rotatable member 12 and the pulley 44 to avoid any axial movement of the second rotatable member 14.

Figure 4:
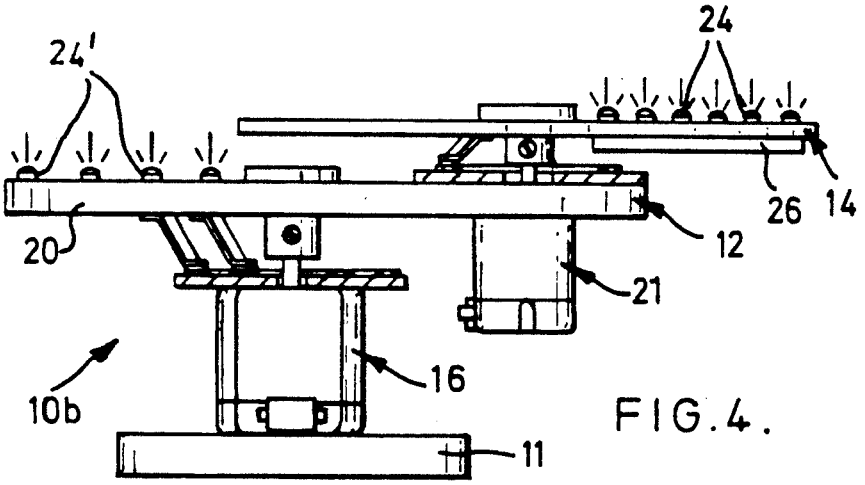
FIG. 4 is a side view of a third embodiment of a display device according to the invention.

FIG. 4 shows a third embodimemt of a display device 10*b* similar in construction and operation to the device 10 of FIGS. 1 and 2. In this embodiment an illumination device comprising a plurality of light-emitting diodes 24' is also provided on the end 20 of the rotatable member 12. These light-emitting diodes 24' are controlled by a part 26*a* of the second part 26 of the control circuit mounted on the underside of the first rotatable member 12. There is no balance weight provided on the end 20 of the first rotatable member 12, the imbalance being taken up by the rotor shaft 16' of the motor 16. Alternatively, the first rotatable member 12 may be balanced by shifting the supporting position on the motor 16 towards the end 19.

Figure 5:
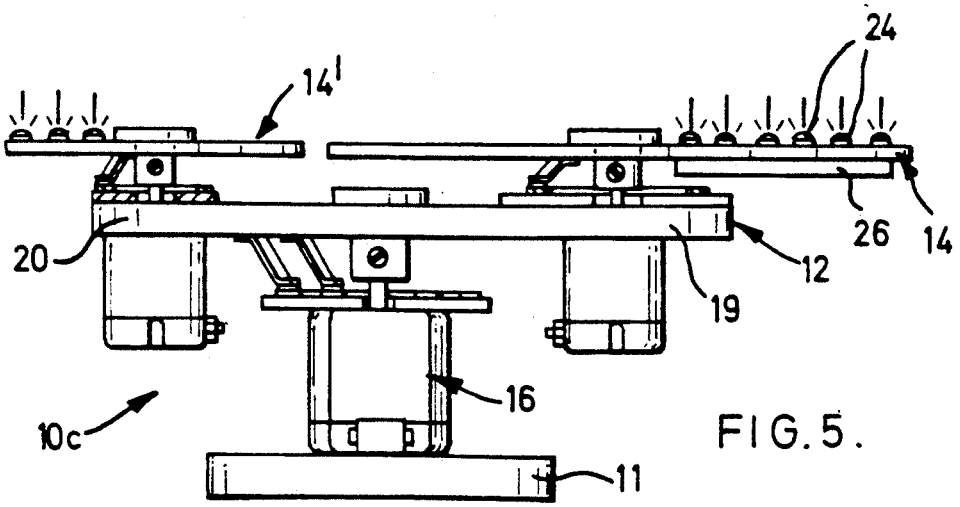
FIG. 5 is a side view of a fourth embodiment of a display device according to the invention.

FIG. 5 shows a fourth embodiment of a display device 10*c* in which an additional second rotatable member 14', similar in construction and operation to the existing second rotatable member 14, is provided at the opposite end 20 of the first rotatable member 12.

Figure 6:
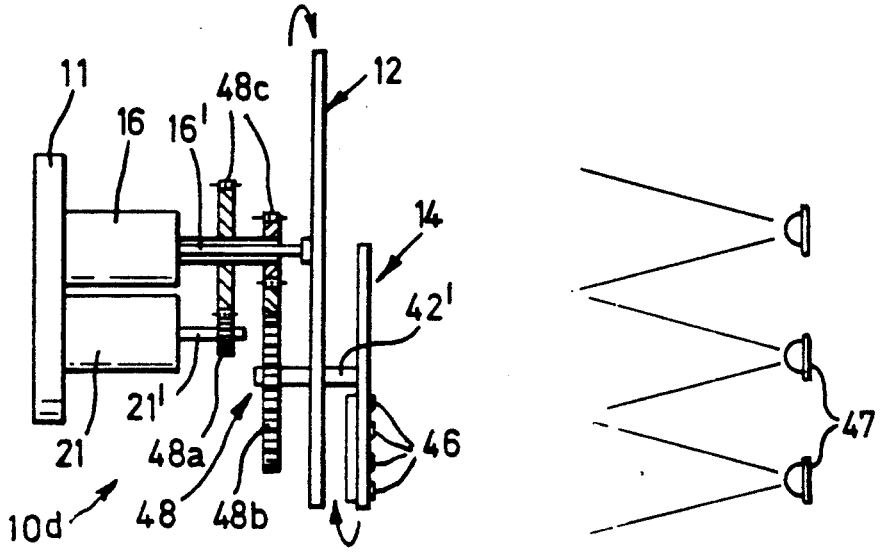
FIG. 6 shows diagrammatically a fifth embodiment of a display device according to the invention.

FIG. 6 shows a fifth embodiment of a display device 10*d* in which an illumination device comprising a plurality of mirrors 46 is provided on the second rotatable member 14. A fixed light source comprising a plurality of light bulbs 47 is provided adjacent to the mirrors 46 so that the light from the light bulbs 47 is reflected by the mirrors 46 to generate a light display pattern. Light generated by the switching of the plurality of light bulbs 47 is reflected by the mirrors 46 to generate a light display pattern. The switching of the plurality of light bulbs 47 is controlled by the second part of the control circuitry in synchronism with the speed of rotation of the motors 16 and 21.

In this embodiment the motors 16 and 21 for rotating respectively the first and second rotatable members 12 and 14 are both mounted on the base 11. The rotational drive of the motor 21 is transmitted to the second rotatable member 14 by means of a gear train 48.

The gear train 48 comprises a gear wheel 48*a* mounted on the rotor shaft 21' of the motor 21, a gear wheel 48*b* mounted on an axial shaft 42' of the second rotatable member 14, and reduction gears 48*c* mounted on a sleeve 48*d* rotatably mounted on the rotor shaft 16' of the motor 16 and connecting the two gear wheels 48*a* and 48*b*.

Figure 7:
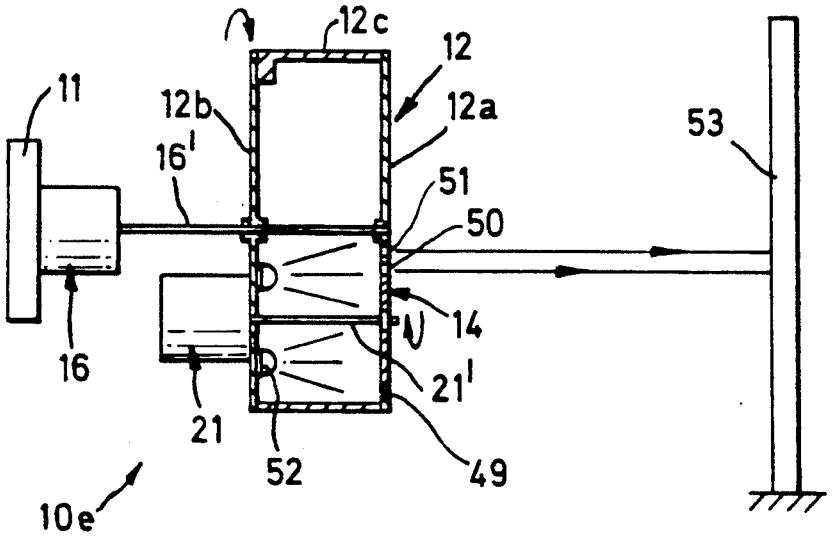
FIG. 7 shows diagrammatically a sixth embodiment of a display device according to the invention.

FIG. 7 shows a sixth embodiment of a display device 10*e* in which the first rotatable member 12 is a closed cylinder comprising two end walls 12*a* and 12*b* and a cylindrical side wall 12*c* connecting the two end walls 12*a* and 12*b*. The motor 16 is attached to the base 11. The first rotatable member 12 is attached to the rotor shaft 16' of the motor 16 at the centres of the two end walls 12*a* and 12*b*.

The motor 21 is mounted on the outer side of the end wall 12*b*. The rotor shaft 21' of the motor 21 extends through the end wall 12*b* with its remote end supporting the second rotatable member 14 an aperture 49 in the opposite end wall 12*a*.

A plurality of apertures 50 are provided in the second rotatable member 14, in each of which a lens 51 is mounted. A plurality of light bulbs 52 are mounted on the inner side of the end wall 12*b* behind the second rotatable member 14. The switching of the light bulbs 52 is controlled by the second part of the control circuitry in synchronism with the speed of rotation of the motors 16 and 21. Light from the bulbs 52 is transmitted by the lenses 51 onto a screen 53 provided in front of the device 10*c*. Hence a light display pattern is generated on the screen 53.

An alternative to this embodiment is to have the apertures 50 left empty. In this case the light from the light bulbs 52 will pass through the apertures 50 and fall directly onto the screen 53.

In the absence of the screen 53, this embodiment, together with its alternative, is also capable of generating a light display pattern when viewed directly.

Figure 8:
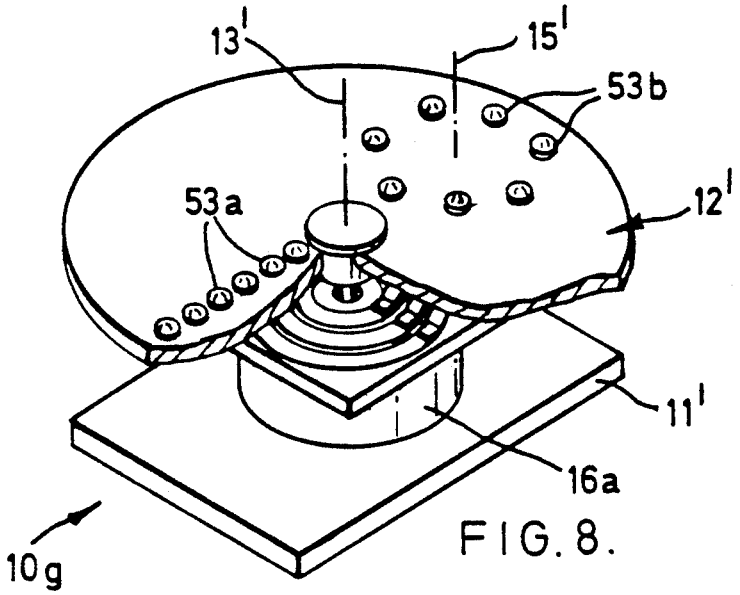
FIG. 8 is a partly cut away perspective view of a seventh embodiment of a display device according to the invention.
Figure 9:
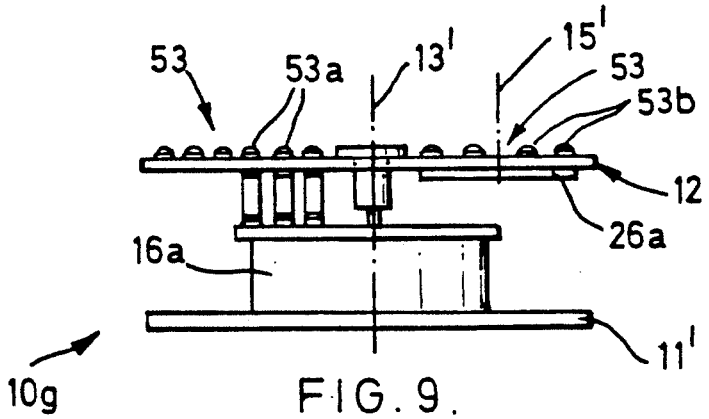
FIG. 9 is a side view of the device of FIG. 8.

FIGS. 8 and 9 show a seventh embodiment of a display device 10*g* having a single rotatable member 12' mounted for rotation about an axis of rotation 13' on and relative to a base 11' by means of an electric motor 16*a*. The construction of this device 10*g* is similar to that of the device 10*b* shown in FIG. 4 except that the second rotatable member 14 and the related parts thereof are absent. The rotatable member 12' is a circular disc and carries a plurality of light-emitting diodes 53.

A control circuit having a control module (not shown) is electrically connected to a first part (not shown) and a second part 26. The first and second parts control respectively the speed of rotation of the motor 16*a* and the switching of the light emitting diodes 53, the second part 26' being mounted on the underside of the rotatable member 12'.

The plurality of light-emitting diodes 53 is divided into two groups 53*a* and 53*b*. The light-emitting diodes 53*a* are located in a radial direction to produce an arcuate light display pattern about the axis of rotation 13' of the rotatable member 12'. The light-emitting diodes 53*b* are located in a circular manner about an axis 15' offset at a distance from the axis of rotation 13'. The diodes 53*b* are switched in a circular sequential order in either direction to simulate an imaginary diode rotating about the axis 15' which is itself being rotated by the rotatable member 12' when the device 10*g* operates. Hence the diodes 53*b* are capable of producing a light display pattern similar to that produced by the diodes 24 of the devices 10, and 10*a* to 10*f*.

Figure 10:
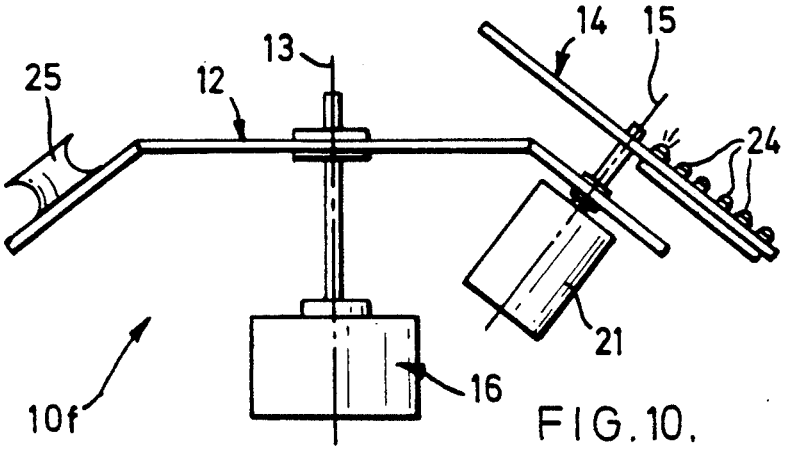
FIG. 10 shows diagrammatically an eighth embodiment of a display device according to the invention.

FIG. 10 shows an eighth embodiment of a display device 10*f* in which the two axes of rotation 13 and 15 are non-parallel, other features being similar to those of the device 10 of FIGS. 1 and 2. In this embodiment the second rotatable member 14 inclines at an angle other than 90 degrees to the axis of rotation 13 of the first rotatable member 12. Hence the light-emitting diodes 24 carried by the second rotatable member 14 will generate a three-dimensional light display pattern when the device 10*f* operates.

Alternatively, the light-emitting diodes 24 in the device embodiments 10, 10*a* to 10*e*, and 10*g* may be mounted at different heights on respective rotatable members 12 and 14 so that three-dimensional light display patterns will be generated when the devices operate.

Figure 11:
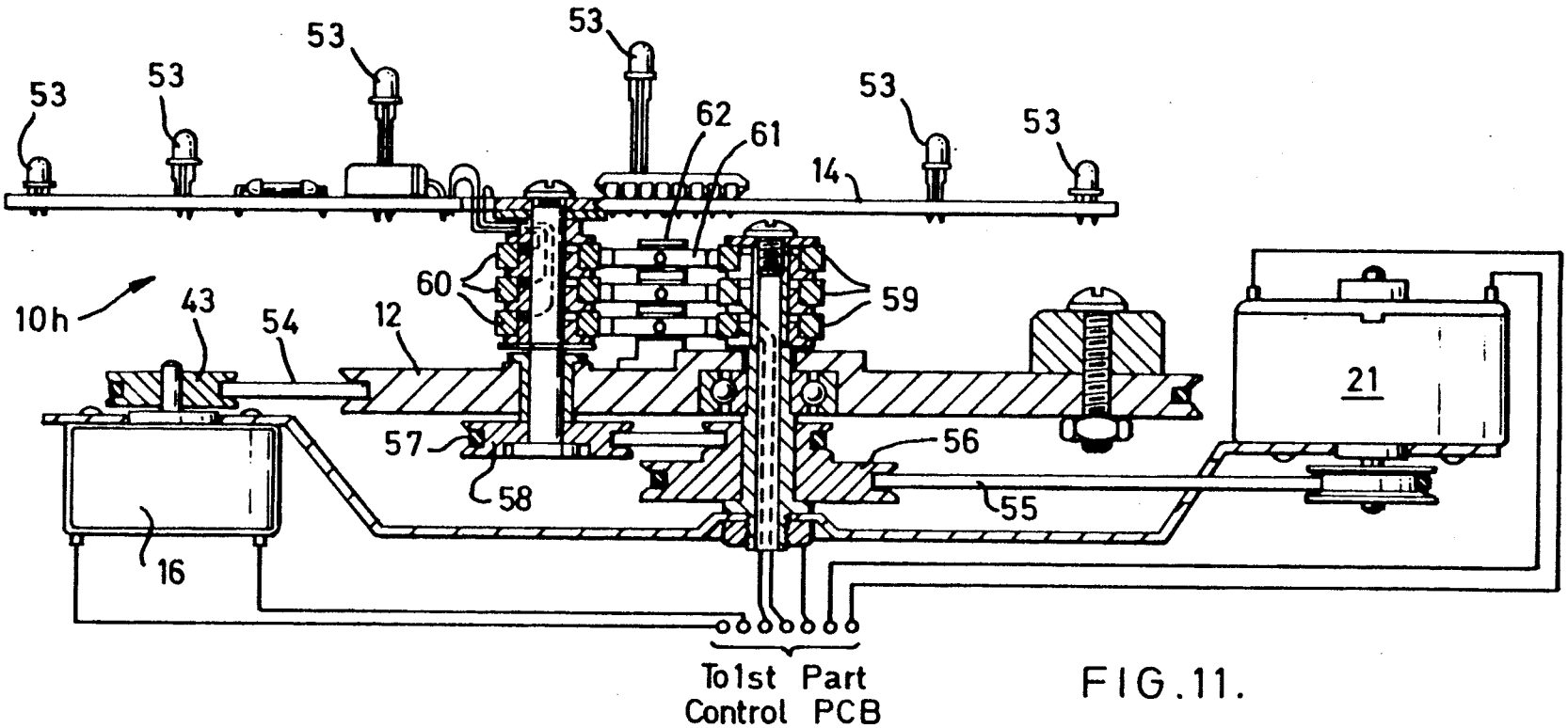
FIG. 11 is a diagrammatic vertical section through a ninth embodiment of a display device according to the present invention.

FIG. 11 shows a ninth embodiment of a display device 10*h*, in which the rotatable members 12 and 14 are driven by belts by respective electric motors 16 and 21. Specifically, rotatable member 12 is in the form of a pulley about which is located a drive belt 54 which passes around a pulley 43 of motor 16. Rotatable member 14 is driven by motor 21 via drive belt 55, intermediate double pulley 56 located on the is of rotation of rotatable member 12, drive belt and pulley 58 located on the axis of rotation of rotatable member 14.

Electric current is supplied to light-emitting diodes of rotatable member 14 via stacks of slip rings 59, 60 mounted respectively on the axes of rotation of rotatable members 12 and 14 and electrically interconnected by means of electrically conductive leaf springs 61 mounted on a pillar 62 upstanding from rotatable member 12.

In this embodiment the rotatable member 14 is in the form of a four-limbed cross (not shown), each arm of the cross and the central part thereof bearing the light-emitting diodes 53.

Figure 12:
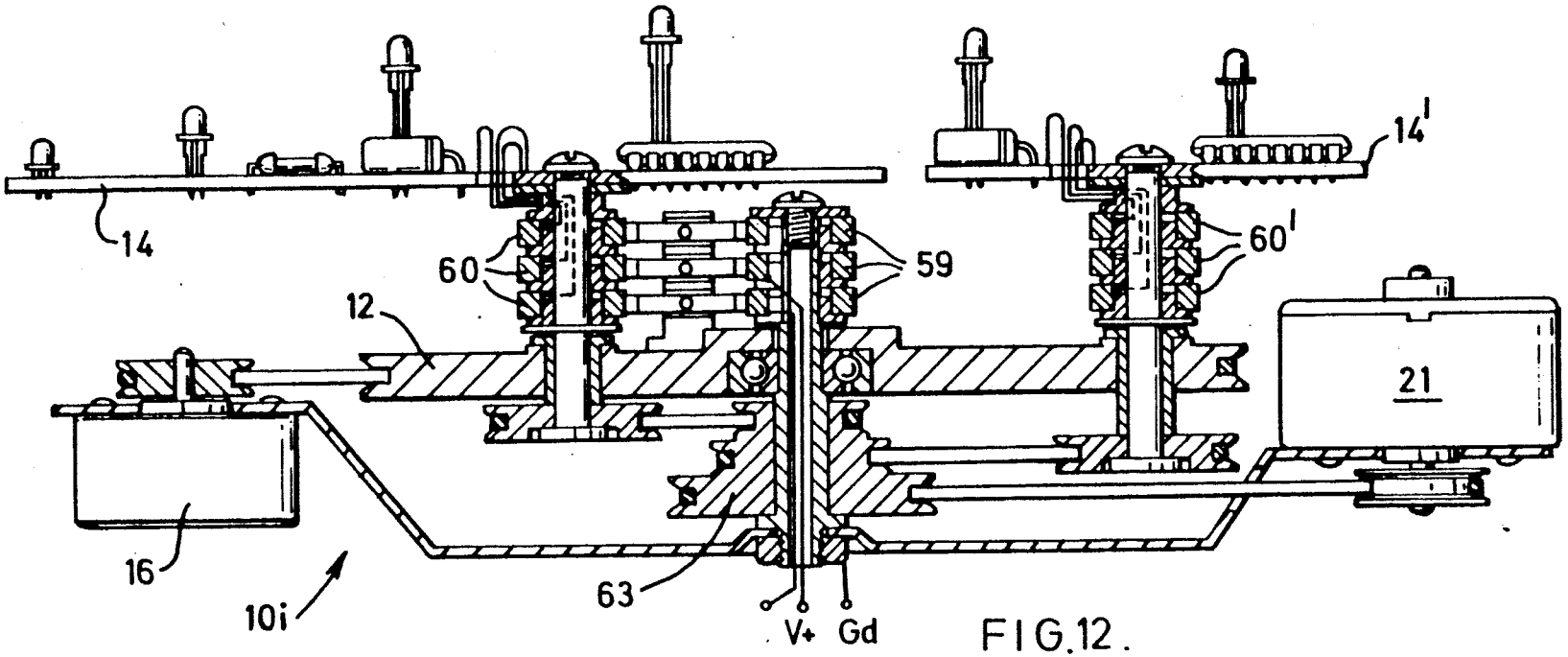
FIG. 12 is a diagrammatic vertical section through a tenth embodiment of a display device according to the present invention.

FIG. 12 shows a tenth embodiment of a display device 10; similar to the embodiment of FIG. 11, but having two rotatable members 14, 14'. In this embodiment a triple pulley 63 relays drive via drive belts to both rotatable members 14, 14' from motor 21.

Electric current is supplied to the light-emitting diodes 53 of rotatable member 14' from slip rings 59 to slip rings 60' via further pillar-mounted electrically conductive leaf springs (not shown).

Figure 13:
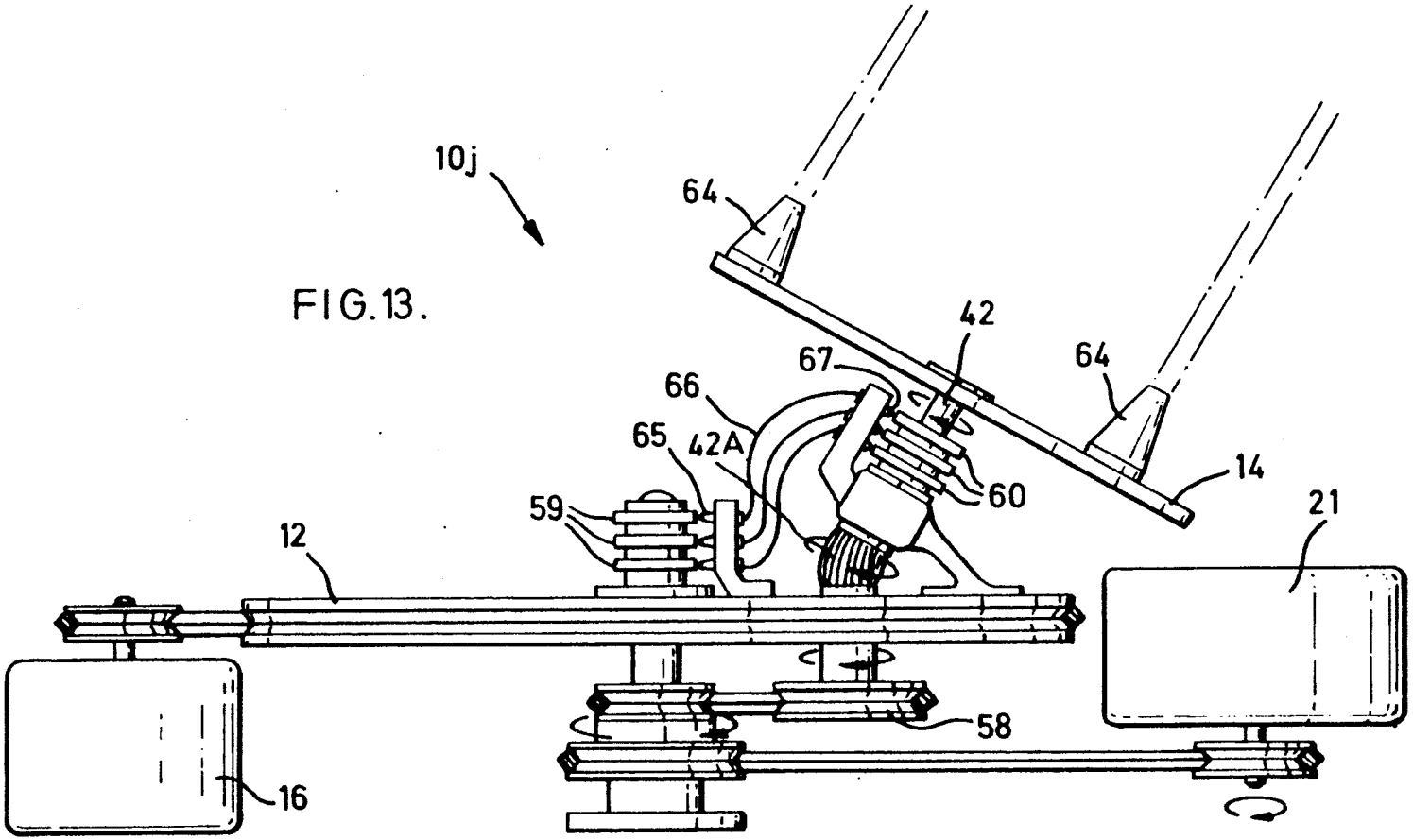
FIG. 13 is a diagrammatic side elevation of an eleventh embodiment of a display device according to the present invention.

FIG. 13 shows an eleventh embodiment of a display device 10*j*, similar to that of FIG. 11, but in which the axis of rotation of rotatable member 14 is non-parallel to the axis of rotation of rotatable member 12. Electric current is supplied to lights 64 via a stack of slip rings 60 electrically connected to slip rings 59 by means of electrically conductive brushes 65, leads 66 and electrically conductive brushes 67. Drive is transmitted from pulley 58 to shaft 42 of rotatable member 14 via tubular rubber coupling 42A.

Figure 14:
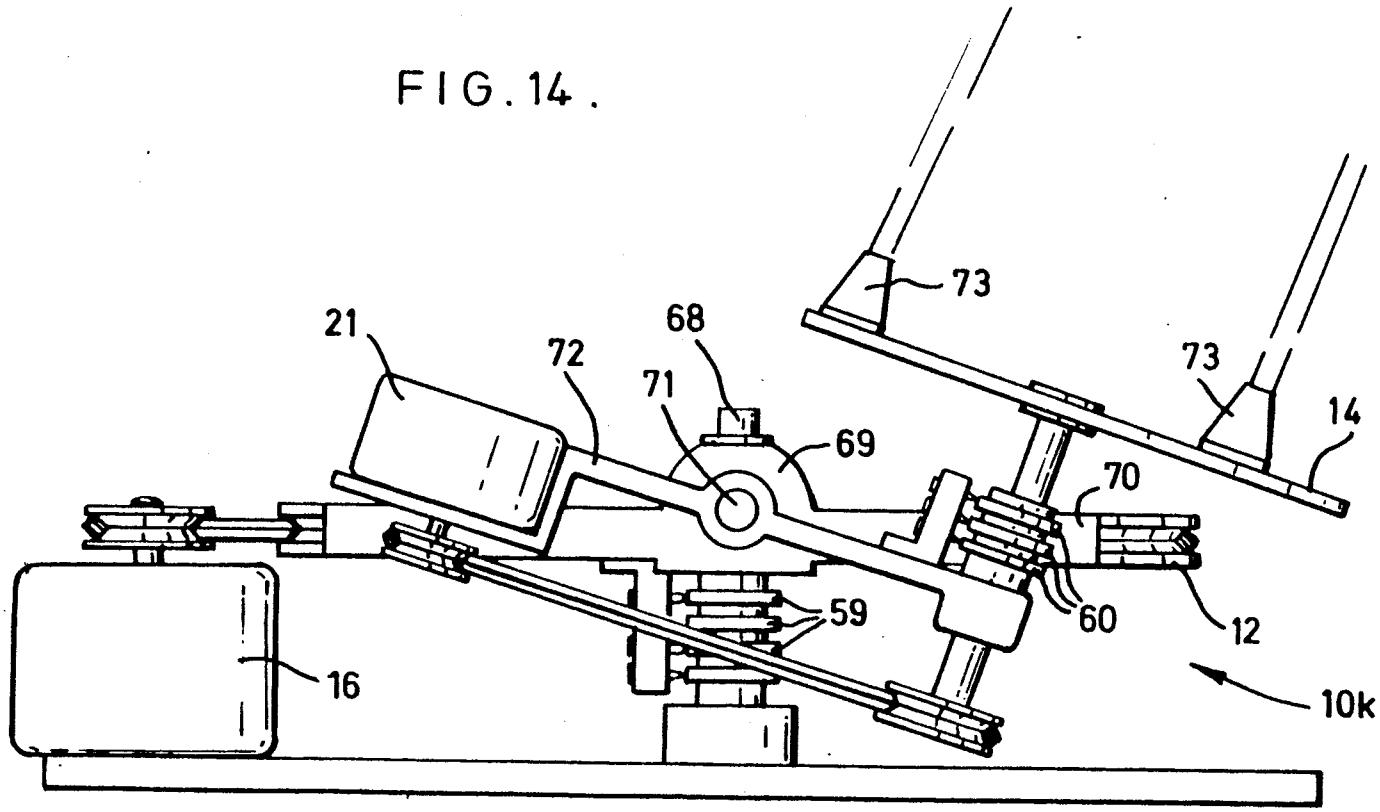
FIG. 14 is a diagrammatic side elevation of a twelfth embodiment of a display device according to the present invention.

FIG. 14 shows a twelfth embodiment of a display device 10*k*. In this embodiment, rotatable member 12 is annular and is supported on shaft 68 by a boss 69 of a diametrical arm 70 of rotatable member 12. A secondary arm 71 extends transversely of boss 69 and carries a transverse support 72 supporting at one end thereof motor 21 and at the other end thereof rotatable member 14.

Electric current is supplied to motor 21 via slip rings 59 by electrical connections (not shown) in arms 70, 71. Electric current is supplied to lights 73 of rotatable member 14 via slip rings 59 and slip rings 60.

Figure 15:
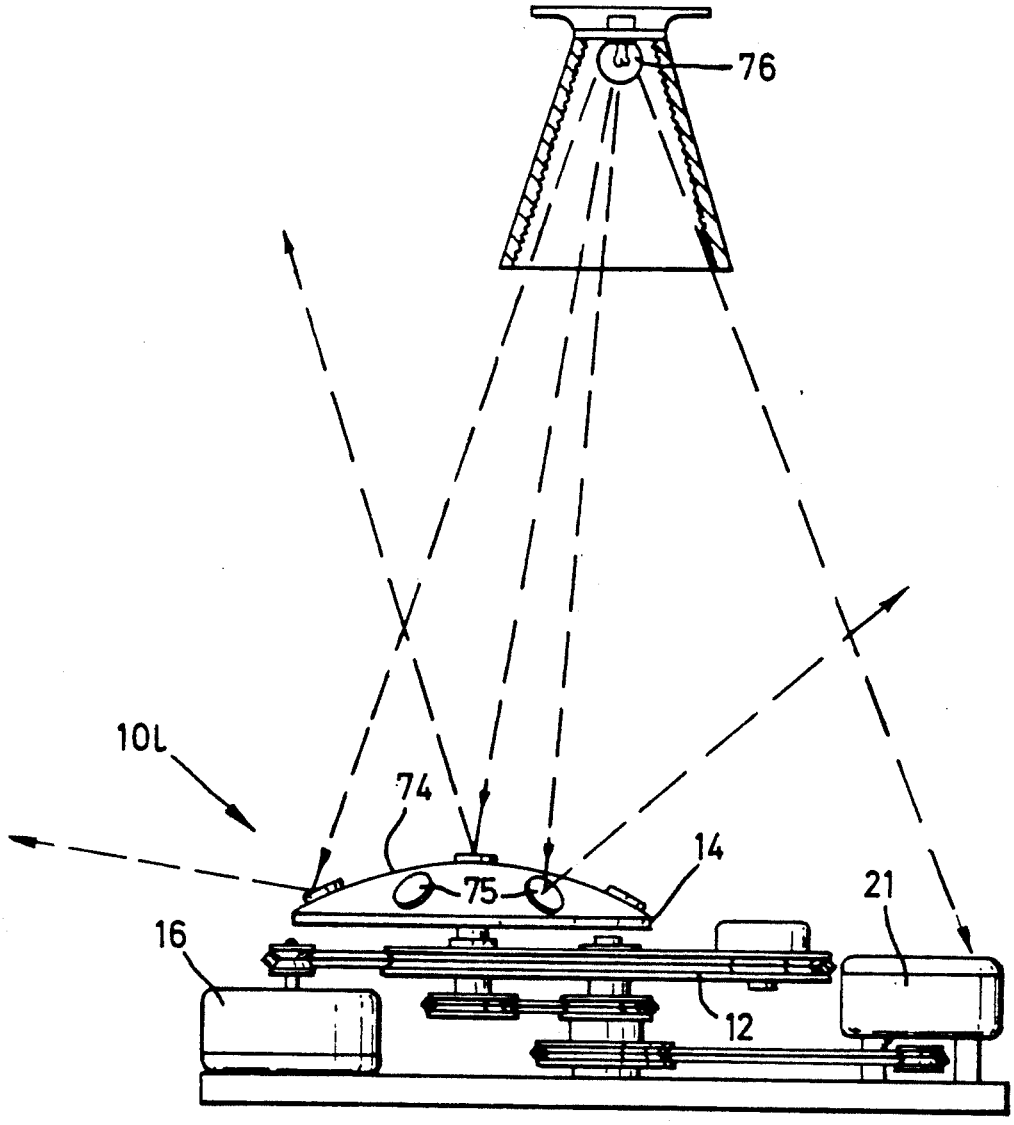
FIG. 15 is a diagrammatic side elevation of a thirteenth embodiment of a display device according to the present invention.

FIG. 15 shows an embodiment of a display device 10*l*, similar to that of FIG. 11 but in which rotatable member 14 is in the form of an upwardly convex member 74. On the convex surface of member 74 a plurality of mirrors 75 is mounted, which may be of different colours to each other, to reflect light from an external source 76.

Figure 16:
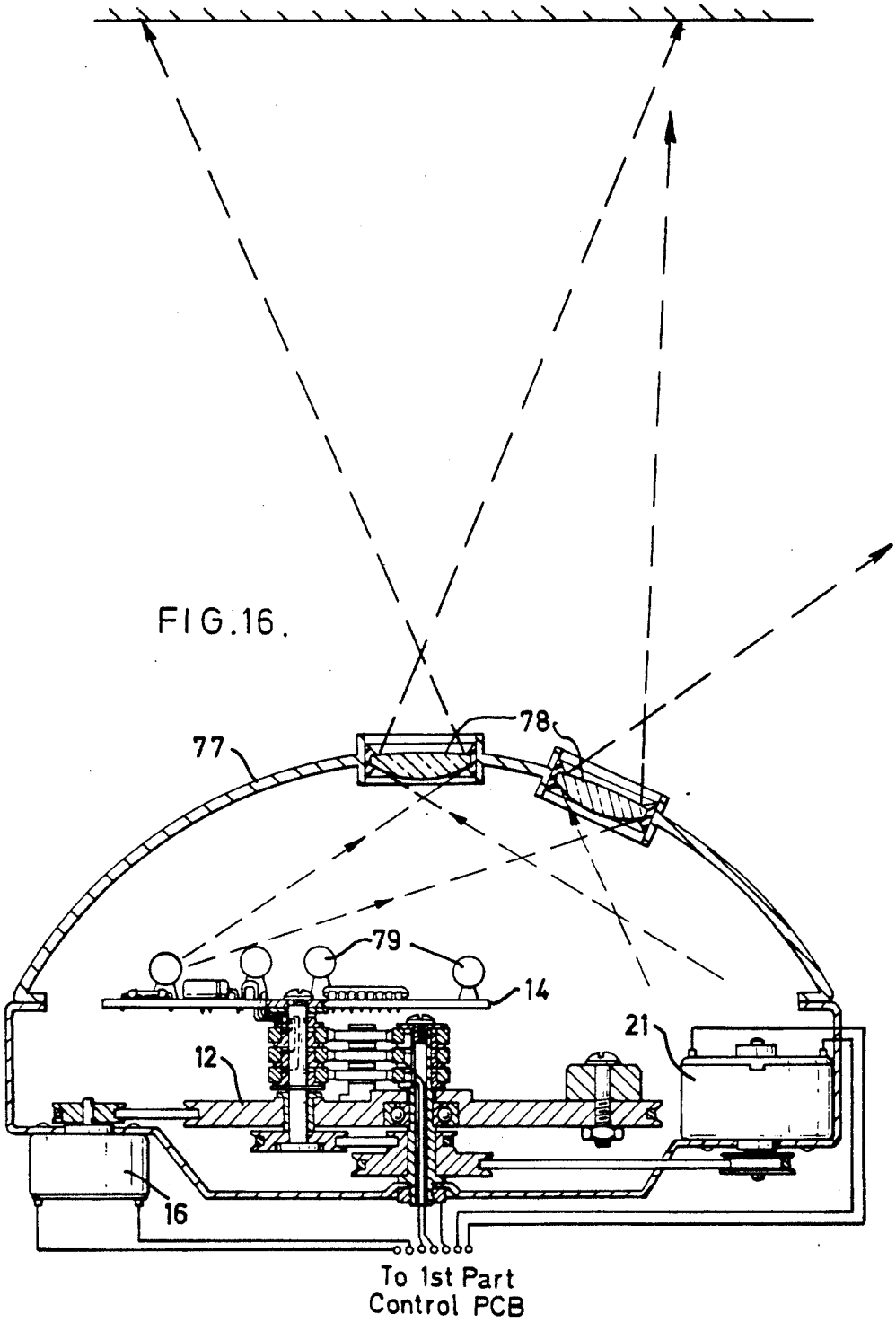
FIG. 16 is a cross-section of a display device substantially in accordance with FIG. 11.

FIG. 16 shows in cross-section a complete display device, generally in accordance with the embodiment of FIG. 11. It will be seen that the device of FIG. 16 incorporates a dome or lid 77 which may be part-spherical. Incorporated into the dome or lid 77 is a plurality of lenses 78 adapted to modify the way in which light from lamps 79 is distributed.

Figure 17:
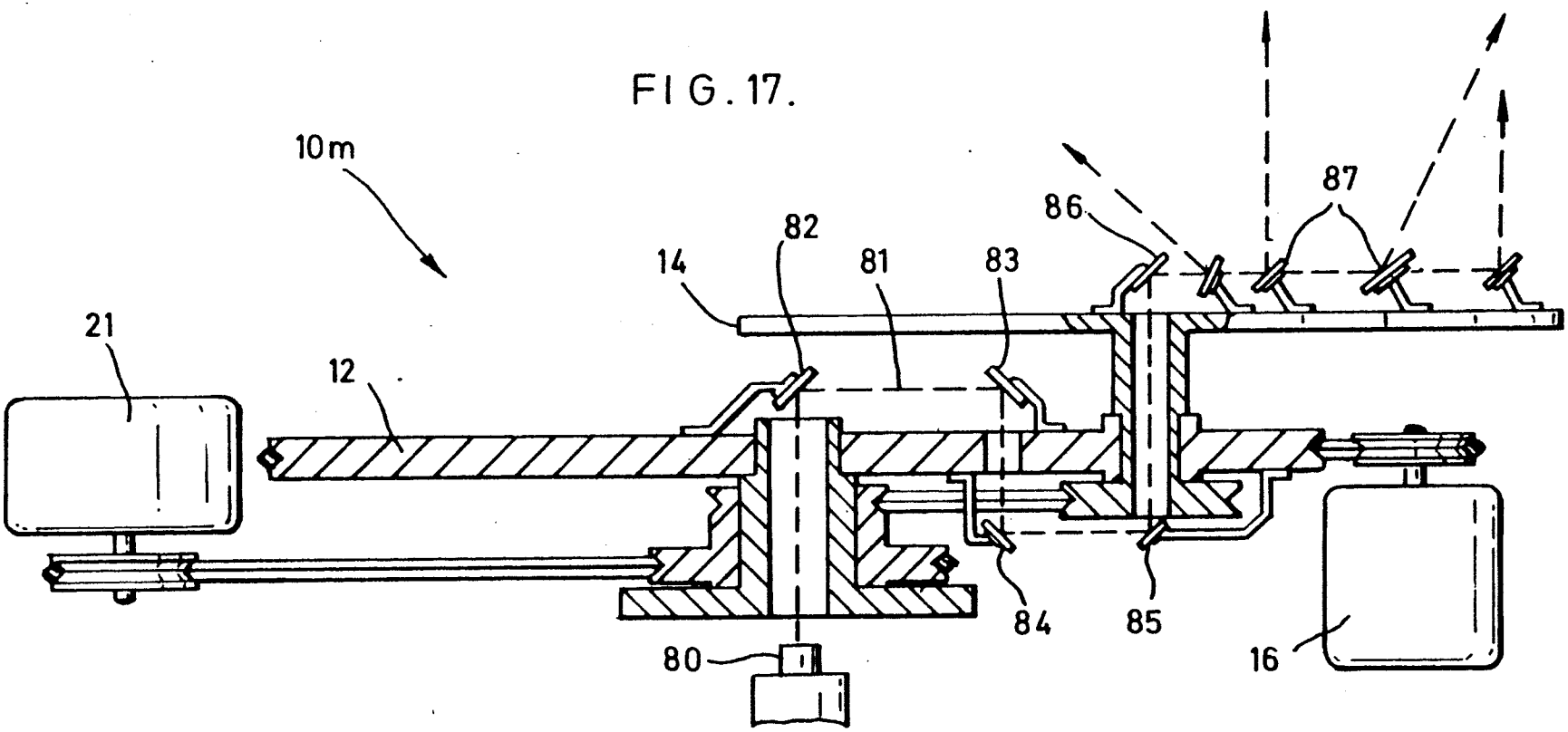
FIG. 17 is a cross-section of a fourteenth embodiment of a display device according to the present invention.

FIG. 17 shows an embodiment of a display device 10*m*, somewhat similar to that of FIG. 11. In the embodiment of FIG. 17, however, light from a single light source 80 is directed along a folded path 81 by means of mirrors 82, 83, 84, 85, 86 onto a series of further mirrors 87 mounted on rotatable member 14 and constituting in this embodiment the illumination means of the present invention. The light source 80 may, if desired, be a source of normal light or of coherent light, e.g. a laser.

Figure 18:
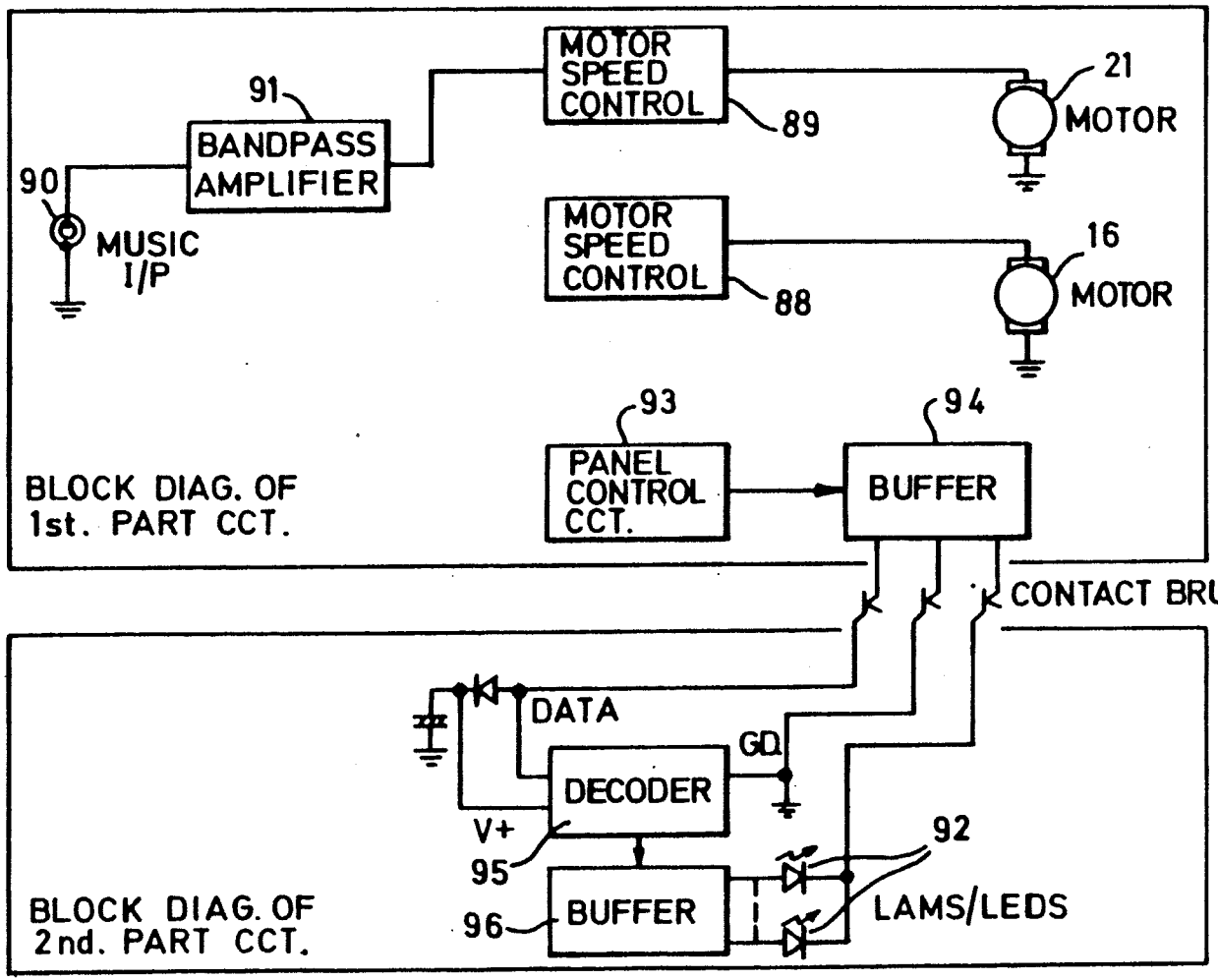
FIG. 18 illustrates diagrammatically circuitry suitable for use in a display device according to the present invention.

Referring now to FIG. 18, there is shown circuitry for controlling a relatively simple embodiment of a display device according to the present invention.

The motor 16 for driving the rotatable member 12 (not shown) is controlled by a manually operable motor speed control 88.

The motor 21 for the rotatable member 14 (not shown) is controlled by a motor speed control 89. This motor speed control 89 receives as an input a music or voice signal from input 90 which signal is amplified by band pass amplifier 91. The speed of the motor 21 is controlled by the motor speed control 89 in accordance with the level of the received music or voice signal.

The lamps or light-emitting diodes 92 which constitute the illumination means in this embodiment are controlled by a panel control circuit 93. The panel control circuit 93 receives as an input the amplified music or voice signal from band pass amplifier 91 and feeds it as a digitised power and data signal via a buffer 94 to a decoder 95.

The decoder 95 switches the lamps or light-emitting diodes 92 on and off in parallel by periodically applying, via a buffer 96, voltage V+ in accordance with the data signal derived from the amplified music or voice signal.

It will be appreciated that respective lamps or light-emitting diodes could with a simple modification be switched independently of each other and at different switching rates.

The bandwidth and/or pass frequency of the band pass amplifier 91 may be adjusted by manual adjustment means (not shown).

It is preferred that the display device of the present invention be provided with four separate means for adjusting the output or display of the device. Firstly, there will generally be provided a combined power ON/OFF and speed controller for motor 16. The speed control may be arranged so that it adjusts the initial speed ratio between motors 16 and 21, e.g. so that in use a display device may be adjusted initially to produce small circular patterns.

There will generally also be provided a sensitivity control for adjusting the sensitivity of the display device to an input music or voice signal.

If twelve light-emitting diodes (LEDs) are employed, each LED can create one individual light pattern. Theoretically twelve LEDs can create a total of $2^{12}$ combinations. A 'scan' control will generally be provided to adjust the time period over which an LED pattern changes to another LED pattern.

Finally there will generally be provided a flash control for adjusting the flash rate of the lamps or LEDs. By means of this control the lights may either appear as periodic dots or as continuous pattern.

The various embodiments of a display device as hereinbefore described give a planetary or circular motion to an illumination device to produce a light display pattern, such pattern preferably being a line pattern.

The pattern is determined by the speed of rotation of the motors driving respective rotatable members, and the switching of respective illumination devices on respective rotatable members.

The term "illumination device" used in the specification includes a light emitter such as a light-emitting diode, a light bulb or a neon tube, a light reflector such as a mirror, and a light transmitter such as a lens.

If a computer or a microprocessor-based controller be used in the control circuitry, the display device may be programmed, for example, to generate numerals, alphabets and geometrical figures for educational purposes. If a musical device be used in the control circuitry, the display device may give visual effect to the music.

The above embodiments are given by way of example only and various modifications may be made. For example, additional pairs of brush and slip ring contacts may be provided in the sliding contacts 27 and 28 to enable the control circuit to give additional control over the motors and the illumination device and/or to provide a return path in place of the motor shafts. It is intended to include all such modifications as fall within the scope of the invention defined by the appended claims.

We claim:

1. A display device for producing a directly viewable display, which device comprises a base, a rotatable member, a first electric motor for rotating said rotatable member about a first axis, illumination means for producing said display and arranged to be rotated about said first axis by said rotatable member, and a second electric motor for causing movement of said illumination means about a second axis different from and non-orthogonal to said first axis, the first and second motors being independently controllable and control means for varying the speed of rotation of one said motors relative to the speed of rotation of the other said motor, a second rotatable member, the first rotatable member being rotatably mounted on the base for rotation relative thereto about the first axis of rotation, the second rotatable member being rotatably mounted on the first rotatable member for rotation relative thereto about the second axis of rotation, and the illumination device being provided on the second rotatable member.

2. A display device as claimed in claim 1, wherein an illumination device is provided on said first rotatable member.

3. A display device as claimed in claim 1, wherein transmission means is provided for transmitting the rotational drive from the first rotatable member to the second rotatable member.

4. A display device as claimed in claim 3, wherein said transmission means comprises two pulleys mounted respectively on the first and second rotatable members for rotation therewith and a belt connecting the two pulleys.

5. A display device as claimed in claim 1, wherein said illumination device comprises a plurality of apertures in the second rotatable member, and a plurality of light bulbs is provided on the first rotatable member, the light from the light bulbs being transmitted through the apertures.

6. A display device as claimed in claim 5, wherein a lens is mounted in each of the plurality of the apertures for transmitting the light from the light bulbs.

7. A combination of a display device as claimed in claim 1 and a light source, wherein said illumination device comprises a reflector on the second rotatable member, and said light source illuminates the reflector under the control of the second part of the control circuit.

8. A combination as claimed in claim 7, wherein said reflector comprises a plurality of mirrors.

9. A combination as claimed in claim 7, wherein the control circuit controls the switching or switching frequency of the light source in synchronism with the speed of rotation of the motor or motors.

10. A display device for producing a directly viewable display, which device comprises a base, a first rotatable member, mounted for rotation on said base about a first axis, a first rotation means for rotating said rotatable member about the first axis, a second rotatable member rotatably mounted on the first rotatable member, an illumination means mounted on the second rotatable member, a second rotation means for rotating the second rotatable member relative to the first rotatable member about a second axis different from and non-orthogonal to said first axis, and control means for independently controlling speed of rotation of the respective rotation means wherein the control means for one of the rotation means includes a speed controller and sound-activated control signal input means for supplying a control signal to the speed controller, the control signal input means comprising a connector for connection to a sound source and a band pass amplifier connected between the motor speed controller and the connector.

11. A display device for producing a display, which device comprises a base, first and second rotatable members, a first electric motor for rotating the first rotatable member, a second electric motor for rotating the second rotatable member and at least one illumination device, wherein the first rotatable member is rotatably mounted on the base for rotation relative thereto about a first axis of rotation, the second rotatable member is rotatably mounted on the first rotatable member for rotation relative thereto about a second axis of rotation, and the illumination device being provided on the second rotatable member, control means for independently varying the speed of rotation of the respective motors wherein the illumination device comprises an electrically driven light-emitter, and means for controlling the switching of said light-emitter and wherein the control means for varying the speed of one of the motors includes a motor speed controller and sound-activated control signal input means for supplying a control signal to the motor controller to control same by sound effects.

12. A display device for producing a directly viewable display, which device comprises a base, a rotatable member, a first electric motor for rotating said rotatable member about a first axis, illumination means for producing said display and arranged to be rotated about said first axis by said rotatable member, and a second electric motor for causing movement of said illumination means about a second axis different from and non-orthogonal to said first axis, the first and second motors being independently controllable and control means for varying the speed of rotation of one said motors relative to the speed of rotation of the other said motor, means for controlling the illumination of the illumination device, said illumination device comprising an electrically driven light-emitter, and said illumination device control means controlling the switching of said light-emitter, said light-emitter comprising a plurality of point sources, said point sources comprising light emitting diodes, and the speed of rotation of the first and second motors and the switching or switching frequency of the illumination device being synchronized.

13. A display device for producing a directly viewable display, which device comprises a base, a first rotatable member, mounted for rotation on said base about a first axis, a first rotation means for rotating said rotatable member about the first axis, a second rotatable member rotatably mounted on the first rotatable member, an illumination means mounted on the second rotatable member, a second rotation means for rotating the second rotatable member relative to the first rotatable member about a second axis different from and non-orthogonal to said first axis, and control means for independently controlling speed of rotation of the respective rotation means wherein the control means for one of the rotation means includes a speed controller and sound-activated control signal input means for supplying a control signal to the speed controller.

14. A device as claimed in claim 13 wherein the first and second rotation means comprise first and second electric motors respectively and wherein the control means for the second motor comprises said speed controller and sound activated control signal input means.

* * * * *